US010991222B2

(12) United States Patent
Liu et al.

(10) Patent No.: US 10,991,222 B2
(45) Date of Patent: Apr. 27, 2021

(54) ACTIVE KITCHEN SAFETY MONITORING SYSTEM AND CONTROL METHOD THEREOF

(71) Applicant: CHENGDU HOMESAFE TECHNOLOGY CO., LTD., Sichuan (CN)

(72) Inventors: Hongbin Liu, Sichuan (CN); Yi Kang, Sichuan (CN); Shijie Xiong, Sichuan (CN); Guang Qian, Sichuan (CN); Yunxiao Zhao, Sichuan (CN); Qiang Zhang, Sichuan (CN)

(73) Assignee: CHENGDU HOMESAFE TECHNOLOGY CO., LTD., Sichuan (CN)

( * ) Notice: Subject to any disclaimer, the term of this patent is extended or adjusted under 35 U.S.C. 154(b) by 0 days.

(21) Appl. No.: 16/925,323

(22) Filed: Jul. 9, 2020

(65) Prior Publication Data

US 2020/0342730 A1 Oct. 29, 2020

Related U.S. Application Data

(63) Continuation-in-part of application No. PCT/CN2019/092003, filed on Jun. 20, 2019.

(30) Foreign Application Priority Data

Dec. 11, 2018 (CN) ..... 201811516015.8
May 10, 2019 (CN) ..... 201910392214.0

(51) Int. Cl.
*G08B 17/10* (2006.01)
*G08B 17/06* (2006.01)
*G08B 25/10* (2006.01)
*G08B 25/04* (2006.01)

(52) U.S. Cl.
CPC ..... *G08B 17/06* (2013.01); *G08B 17/10* (2013.01); *G08B 25/04* (2013.01); *G08B 25/10* (2013.01)

(58) Field of Classification Search
CPC ..... G08B 17/06
USPC ..... 340/628, 630, 632, 539.11, 540, 541
See application file for complete search history.

(56) References Cited

U.S. PATENT DOCUMENTS

2011/0126823 A1* 6/2011 Barritt ..... F23N 5/00 126/39 BA
2017/0329358 A1* 11/2017 Ferguson ..... H04L 67/24
2020/0182477 A1* 6/2020 Bentley ..... F24C 3/126

* cited by examiner

*Primary Examiner* — Tai T Nguyen

(57) ABSTRACT

An active kitchen safety monitoring system includes a fire prevention alarm device, a gas safety valve, a multifunctional gateway, a server and a user terminal. The fire prevention alarm device sends temperature data of multiple locations on the kitchen stove and kitchen stove usage safety alarm information, both of which are monitored in real time, to the multifunctional gateway. The gas safety valve sends internal pressure data of the gas pipeline, working state information of the motor valve and gas usage safety alarm information to the multifunctional gateway. The multifunctional gateway sends all of the received data to the user terminal through the server, receives and executes operation instructions from the user terminal. The server stores various data and transmits the operation instructions. Through the user terminal, the user is able to view data information and control the gas safety valve and the multifunctional gateway.

15 Claims, 4 Drawing Sheets

ACTIVE KITCHEN SAFETY MONITORING SYSTEM AND CONTROL METHOD THEREOF

CROSS REFERENCE OF RELATED APPLICATION

This is a Continuation-In-Parts application of the International Application PCT/CN2019/092003, filed Jun. 20, 2019, which claims priority under 35 U.S.C. 119(a-d) to CN 201811516015.8, filed Dec. 11, 2018, and CN 201910392214.0, filed May 10, 2019.

BACKGROUND OF THE PRESENT INVENTION

Field of Invention

The present invention relates to the field of safety monitoring technology, and more particularly to an active kitchen safety monitoring system and a control method thereof.

Description of Related Arts

While being used, kitchen stoves usually need someone to take care of them to prevent accidents during cooking, and especially fire hazards caused by forgetting to turn off the kitchen stoves. However, in actual life, it often happens that the cook leaves the kitchen temporarily due to other affairs, and then in the course of doing other affairs, the cook often forgets that the kitchen stove is working. In addition, with the increasing aging of society, the elderly population is increasing, and as the age increases, the memory of the aged gradually declines, which will inevitably cause the situation, of forgetting to turn off the kitchen stove due to leaving the kitchen for too long, to gradually increase. Accordingly, it means that forgetting to turn off the kitchen stove, the important hidden danger of a family kitchen fire hazard, will gradually increase. At present, there are products such as kitchen timers on the market, so that by setting the kitchen timer, the situation, that the user forgets to turn off the kitchen stove while leaving the kitchen, is avoided. However, the opening, closing, and time setting of the kitchen timer require human participation, otherwise it will not work. Therefore, even if a kitchen timer is purchased, it is unable to fundamentally solve the safety hazard caused by forgetting to turn off the kitchen stove.

In order to solve the above problems, the existing products for kitchen safety monitoring are mainly smoke alarms, infrared or ultraviolet fire detectors and some fire detection device for image recognition through cameras. However, in the kitchen, where there will be open fire operations and a lot of smoke, it is easy to cause false alarms of fire detection equipment. The fire detection devices for image recognition through cameras not only have the disadvantages of high cost and large communication bandwidth, but also involve the risk of personal privacy being leaked. The above-mentioned fire detection devices are all passive detection devices, that is, only when a fire accident has occurred, the above fire detection devices will issue an alarm; and at this time, it has actually caused a certain degree of loss.

For families who like cooking soup, most of them have the experience of flame extinguishment during the normal soup making. The reason is that a small fire is often used while cooking soup, when the air pressure is low or the wind near the kitchen stove is relatively high, the small flame used is easy to extinguish. According to the national standards, the existing kitchen stoves are equipped with flameout protection devices. The foregoing situations will not cause a safety accident after flame extinguishment, but will break the user's living arrangements and affect the user's life. Therefore, users desperately hope that when the fire of the kitchen stove is normally used, after accidental flame extinguishment, a product is able to actively remind the user without affecting the user's normal arrangement, and there is no need for the user to stand by the kitchen stove and is unable to handle other affairs. However, there are no products on the market that can intelligently judge the accidental flame extinguishment while normally firing, and then actively remotely remind the user online.

At present, the gas pipelines entering a household are all adjusted to a certain pressure range by a pressure regulating device and then delivered to users. When the pressure regulating device is abnormal in operation, is being debugged and the gas is stopped, the gas pipeline is under-pressured or over-pressured, which is likely to cause gas safety accidents. In addition, the connection between the ball valve at the rear end of the gas meter and the kitchen stove is mostly achieved by the hose or bellow, if the hose is used, its service life is short, and it is easily damaged by external forces such as rats, resulting in pipeline gas leakage and safety accidents. Therefore, in order to avoid such phenomena, there are devices on the market that are designed based on mechanical principles and installed in low-pressure gas pipelines in households to detect overpressure, underpressure and overcurrent in gas pipelines, such as self-closing valves. At the same time, there is also the solution which comprises a gas alarm and an electromagnetic linkage shut-off valve for preventing gas safety accidents.

Existing mechanical self-closing valves use the pressure difference of the gas flowing through the valve to reach a sufficient threshold value before triggering the function of safe shutdown. To reach the threshold value, the required flow rate is about 1.2 m/h, that is, when the flow rate is below 1.2 m/h, this type of mechanical self-closing valve will not be closed. However, the problems that often occur in domestic gas pipelines are that the hoses are bitten by mice, the hose interfaces are aging, loose, or fall off. These situations are slowly changing. When the domestic gas pipelines first loosen or are bitten by mice, the flow generated is extremely small (which is less than 0.016 m/h), and the existing mechanical self-closing valves and other devices are unable to achieve the detection of micro-flow, which is the biggest defect of mechanical products such as gas self-closing valves. At the same time, since this type of self-closing valve has a purely mechanical structure, it does not have the function of remote operation. When the user goes out and forgets to close the gas valve, he is unable to actively close the gas valve by other manners. In summary, this type of mechanical self-closing valve has some detects of an excessively high threshold value, narrow coverage, and low accuracy. Moreover, it is unable to automatically and regularly check the gas hose for loose connections, rat bites, and hose aging; and the user is unable to remotely check online and control the valve status.

There are two major shortcomings of the solution which uses the gas alarm and the electromagnetic linkage cut-off valve. Firstly, the gas sensor of the gas alarm has a very short service life and needs to be calibrated regularly, otherwise it is invalid, and the gas sensor of the gas alarm now installed in the user's home is basically not calibrated within a certain time, and most gas alarms have exceeded the service life of their internal gas sensors. Secondly, this type of gas alarm is a concentration detection type gas alarm, which has different detection sensitivity in different spaces. When the user opens the kitchen window, the gas in the air is evacuated to the outside, and the indoor concentration has not reached the threshold value set by the gas alarm, so that even if the hoses are loose or bitten by mice, the gas sensor is unable to detect the gas leakage.

SUMMARY OF THE PRESENT INVENTION

An object of the present invention is to provide an active kitchen safety monitoring system, which is able to solve the problems that the existing kitchen safety monitoring systems only take further actions after a safety accident occurs, and are unable to achieve autonomous test for judging whether there is a safety problem in gas use. Moreover, the system is able to solve the problem of inevitable hidden safety and economic loss in the kitchen caused by the inability to promptly remind the user to take corresponding measures.

The present invention adopts technical solutions as follows.

An active kitchen safety monitoring system comprises a fire prevention alarm device, a gas safety valve, a multifunctional gateway, a server and a user terminal, wherein: the fire prevention alarm device, the gas safety valve and the multifunctional gateway are in communication connection with each other, the multifunctional gateway is connected with the user terminal through the server;

the fire prevention alarm device is configured to judge whether a kitchen stove has a fire risk based on real-time monitored temperature data of multiple locations on the kitchen stove, and then according to a judgement result, determine whether kitchen stove usage safety alarm information is sent to the multifunctional gateway and whether a motor valve close instruction is sent to the gas safety valve, and then send the real-time monitored temperature data to the multifunctional gateway;

the gas safety valve is configured to control a working state of a motor valve of the gas safety valve according to an internal pressure of a gas pipeline, send internal pressure data of the gas pipeline, working state information of the motor valve and gas usage safety alarm information to the multifunctional gateway, and simultaneously receive an instruction from the multifunctional gateway for daily timing or intelligently opening/closing the motor valve, wherein the gas usage safety alarm information comprises unexpected flameout, overpressure, underpressure, loose connection, hose breakage and hose falling of the gas pipeline;

the multifunctional gateway is configured to receive the temperature data, the internal pressure data of the gas pipeline, the working state information of the motor valve, the kitchen stove usage safety alarm information and the gas usage safety alarm information, send all of the received data and information to the user terminal through the server, and receive and execute an operation instruction from the user terminal;

the server is configured to store the temperature data, the internal pressure data of the gas pipeline, the working state information of the motor valve, receive and send the operation instruction from the user terminal, wherein the operation instruction comprises timing, opening the motor valve and closing the motor valve;

the user terminal is configured to view the temperature data collected by the fire prevention alarm device by a user, the internal pressure data of the gas pipeline, the working state information of the motor valve, the kitchen stove usage safety alarm information and the gas usage safety alarm information, and also configured to control the gas safety valve and the multifunctional gateway.

Preferably, the gas safety valve comprises a safety valve housing, wherein a closed valve cavity is provided within the safety valve housing, an air intake port and an air exhaust port are provided on the closed valve cavity, a motor valve for communicating the air intake port and the air exhaust port is located within the closed valve cavity; a central control panel, a valve switching button and a first power module are located outside the closed valve cavity and inside the safety valve housing; all of the motor valve, the valve switching button and the first power module are connected with the central control panel through wires and FPCs (Flexible Printed Circuits).

Preferably, an air intake pressure sensor and an air exhaust pressure sensor are provided within the closed valve cavity; the air intake pressure sensor, which is located at the air intake port provided on the closed valve cavity, and is electrically connected with the central control panel; the air exhaust pressure sensor, which is located at the air exhaust port provided on the closed valve cavity, and is electrically connected with the central control panel.

Preferably, the gas safety valve further comprises a prompt module for reminding the user of the current working state information of the motor valve and the usage state of the gas pipeline, wherein the current working state information of the motor valve and the usage state of the gas pipeline comprise the motor valve is opened, the motor valve is closed, insufficient power of the first power module, and loose connection, hose breakage, hose falling, underpressure and overpressure of the gas pipeline; the prompt module is connected with the central control panel through wires or FPCs (Flexible Printed Circuits).

Preferably, a leading-out hole is provided on the closed valve cavity; a seal joint is inserted into the leading-out hole; the wires of all of the air exhaust pressure sensor, the air intake pressure sensor and the motor valve are led out from the seal joint and then connected with the central control panel.

Preferably, the fire prevention alarm device comprises:

a second private network communication module for connecting with the multifunctional gateway and the gas safety valve;

an alarm module;

an infrared array sensor for monitoring the temperature data at the several locations on the kitchen stove in real time and sending the temperature data monitored to a data processing module;

the data processing module for receiving the temperature data monitored by the infrared array sensor, sending to the multifunctional gateway, respectively finding two maximum temperature data $T_{max1}$ and $T_{max2}$ in the temperature data received both before and after, judging whether the kitchen stove has the fire risk based on a difference between $T_{max1}$ and $T_{max\ 2}$ alarming through the alarm module if the kitchen stove has the fire risk, sending the kitchen stove usage safety alarm information to the multifunctional gateway and sending the motor valve close instruction to the gas safety valve; and a second power module for providing the second private network communication module, the alarm module, the infrared array sensor and the data processing module with power.

Preferably, the fire prevention alarm device further comprises a body recognition module for detecting human signals in the kitchen, and an environmental detection module for detecting gas concentration in the kitchen, wherein both the body recognition module and the environmental detection module are connected with the data processing module.

Preferably, the fire prevention alarm device further comprises a timing unit, wherein the timing unit, which is configured to calculate the time that the user leaves the kitchen during cooking, is integrated within the data processing module.

Preferably, the multifunctional gateway comprises a third power module, a micro controller module, a third private network communication module for connecting with the gas safety valve and the fire prevention alarm device, a public network communication module for connecting with the server, a display module and a button control module.

Preferably, the multifunctional gateway further comprises a voice broadcast module for reminding the user of related information of the gas safety valve and the multifunctional gateway.

Preferably, the button control module comprises seven control buttons, which are respectively as follows:

an ignore button, wherein the alarm is stopped by pressing the ignore button under abnormal alarm states;

a valve control button for changing the working state of the current motor valve;

five selection buttons for respectively setting hours, ten minutes, minutes of timing, resetting and starting to control the on/off of the motor valve of the gas safety valve by the user.

Also, the present invention provides a control method of an active kitchen safety its monitoring system, wherein the control method is performed at an intelligent switch safety valve mode and comprises steps of:

(S1) when a motor valve is closed, obtaining a pressure value Pe1 collected by an ambient pressure sensor and a pressure value Po1 collected by an air exhaust pressure sensor, and obtaining a relative pressure Pob1 at an air exhaust port, wherein Pob1=Po1−Pe1;

(S2) when the motor valve is closed and a user presses a fire button of a kitchen stove to ignite, obtaining a pressure value Pe2 collected by the ambient pressure sensor and a pressure value Po2 collected by the air exhaust pressure sensor, and obtaining a relative pressure Pob2 at the air exhaust port, wherein Pob2=Po2−Pe2 and Pob2=0 at this time;

(S3) when a central control panel detects Pob2 is instantaneously reduced to 0, opening the motor valve after a delay of 1 second, and then closing the gas safety valve after a delay of 1 second, and then obtaining a pressure value Pe3 collected by the ambient pressure sensor and a pressure value Po3 collected by the air exhaust pressure sensor after a delay of 1 second, and finally obtaining a relative pressure Pob3 at the air exhaust port, wherein Pob3=Po3−Pe3; and (S4) respectively judging a relationship between Pob3 and Pob1, and a relationship between Pob3 and Pob2, wherein:

if Pob3 is close to Pob1, it is considered that the user pressing the fire button of the kitchen stove to ignite is a fact, the central control panel controls the motor valve to be automatically opened, so that the user normally uses fire;

if Pob3 is close to Pob1, namely, Pob3 is close to 0 Pa, then (S3) is repeated after a delay of 1 second to obtain a relative pressure Pob3' for re-judgement, when an amount of repetitions exceeds 5 times, and Pob3' is always close to Pob2, it is considered that the gas pipeline is fallen off or damaged, the motor valve is closed and pipeline failure is reported through the first private network communication module;

when Pob3' is close to Pohl during re-judgement, the central control panel controls the motor valve to be automatically opened.

Preferably, the control method of the active kitchen safety monitoring system is performed at timed automatic switch safety valve mode and comprises steps of:

(S5) defining a self-check time period and a detection frequency of the gas safety valve, and a valve control module automatically closing the motor valve during the defined self-check time period;

(S6) after closing the motor valve, through the air exhaust pressure sensor, obtaining a gas pressure value $P_b$ within a segment of the gas pipeline between the motor valve and the kitchen stove in real-time, wherein if the segment of the gas pipeline is in an absolutely sealed state, there is no downward trend in the gas pressure value $P_b$, and the segment of the gas pipeline is always under steady pressure; if there is a loose connection in the gas pipeline or a hose is broken or the hose is falling off, there is a downward trend in the gas pressure value $P_b$, and the gas pressure value $P_b$ drop to an atmospheric pressure value $P_a$ of an external environment within a certain time, which means that there is the loose connection in the gas pipeline or the hose is broken or the hose is falling off; and (S7) while determining there is the loose connection in the gas pipeline or the hose is broken or the hose is falling off, immediately closing the motor valve, sending an alarm to the third private network communication module of the multifunctional gateway through the first private network communication module, sending an instruction to the server through the public network communication module of the multifunctional gateway, and notifying the user terminal through networks.

Preferably, the control method of the active kitchen safety monitoring system further comprises intelligently closing the gas safety valve which comprises steps of:

(S8) when the motor valve is opened and the fire continues on the kitchen stove, obtaining a pressure value Pi4 collected by the air intake pressure sensor and a pressure value Po4 collected by the air exhaust pressure sensor, and obtaining a relative pressure Pio4 between an air intake port and an air exhaust port, wherein Pio4=Pi4−Po4;

(S9) when the motor valve is opened and there is no fire on the kitchen stove, obtaining a pressure value Pi5 collected by the air intake pressure sensor and a pressure value Po5 collected by the air exhaust pressure sensor, and obtaining a relative pressure Pio5 between the air intake port and the air exhaust port, wherein Pio5=Pi5−Po5; and (S10) obtaining a pressure loss Pd=Pio4−Pio5, determining that the user turning off the kitchen stove is a fact when Pd is close to a threshold value N and the central control panel completes valve closing detection after a delay of t, and closing the motor valve.

Preferably, the control method of the active kitchen safety monitoring system further comprises a motor valve closing detection process which comprises steps of:

(S11) when Pd is close to the threshold valve N and the delay time t has expired, the central control panel controlling the motor valve to slowly turn off, wherein the motor valve is gradually closed to a certain degree and stays for a period of time after being closed to the certain degree every time, Pd' is obtained; and (S12) judging a variation tendency of Pd', wherein:

if Pd' is larger than the threshold value M, it is considered that at this time, there is a small flow of gas circulation, the user is using the minimum fire, this test is over, and the motor valve is fully opened;

if the motor valve is gradually closed till the motor valve is fully closed, Pd' is always lower than the threshold value N, it is considered that at this time, the user turning off the kitchen stove is a fact, so that it is determined that the motor valve is turned off.

Furthermore, when the user uses the minimum fire for cooking, the pressure loss Pd at the minimum fire may not be much different from the pressure loss at the time of turning off the kitchen stove, or may be lower than N. If the gas safety valve is closed at this time, the user's normal cooking may be affected. Therefore, it is necessary to determine whether the user is actually turning off the kitchen stove or using the minimum fire for cooking at this time. The gas safety valve is closed when the kitchen stove is really turned off, and the gas safety valve is not closed for the minimum fire cooking. In order to accurately judge, the air exhaust port of the present invention is set to be a triangle, which makes the flow area of the motor valve change nonlinearly during the gradual closing of the motor valve, so that it is able to avoid misjudgment while determining the kitchen stove is turned off or the kitchen stove is in low fire cooking state. Since the gas flow rate is also very low when the user cooks with the minimum fire, if the gas flow area changes linearly during the valve closing process, it is easy to misjudge the user's cooking behavior with the minimum fire as the user turning off the kitchen stove. Specifically, when Pd is lower than N and the time delay t has expired, the motor valve closing detection process is activated, that is, the gas safety valve is slowly closed and gradually closed to a certain degree, and stays for a period of time after being closed to the certain degree every time, a new pressure loss Pd' is obtained; an then a variation tendency of Pd' is judged, wherein: if in the process of slow valve closing, Pd' has a gradual increase trend and Pd' is greater than M, it is considered that there is a small flow, and the gas safety valve is fully opened, this test is completed, the gas safety valve is unable to be closed. If the gas safety valve is gradually closed till the gas safety valve is fully closed, there is no trend of increasing Pd' and Pd' is always not higher than the threshold value N, the gas safety valve is directly closed and has no need to be opened, and it is judged that at this time, the user really turns off the kitchen stove, thereby completely avoiding the situation of accidentally turning off the kitchen stove and affecting the user's normal cooking.

Preferably, the threshold value N is 30 Pa, the threshold value M is 50 Pa, the time t is 10 min.

In summary, due to the adoption of the above technical solutions, the beneficial effects of the present invention are as follows.

(1) In the present invention, the temperature status on the kitchen stove is monitored by the fire prevention alarm device. The gas safety valve controls the working state of the motor valve thereof according to the internal pressure data of the gas pipeline, and simultaneously receives and executes instructions from the fire prevention alarm device, the multifunctional gateway and the use terminal. In addition, the user is able to control the gas safety valve and the multifunctional gateway through the user terminal, as well as view the relevant data and information collected by the system during work. The system provided by the present invention is able to autonomously test the gas usage safety, directly take corresponding measures or remind the user to take corresponding measures according to the test results, so as to avoid hidden dangers of gas safety, reduce economic losses, and is highly practical.

(2) In the present invention, the gas safety valve obtains the gas pressure data inside the gas pipeline in real time through the internal high-precision digital pressure sensor, and there is no service life limit, which makes up for the problem that the gas sensor of the existing gas alarm device has a short service life and is out of work due to unable to be calibrated in time. The gas safety valve provided by the present invention is not limited by the user's kitchen environment, whether the user opens the window, the kitchen space, etc. The test sensitivity is consistent under any conditions, making up for the shortcoming of existing gas alarm devices with different sensitivity in different environments.

(3) In the present invention, when the timing mode is selected, the gas safety valve is able to automatically detect the risk of the gas pipeline online during the period of specified gas pipeline detection, making up for the problems that the existing mechanical self-closing valves are unable to detect any different degree of slight looseness of gas pipeline connections and slight damage of hoses. The present invention is able to realize the safety inspection once a day, find the tiny looseness or damage of the gas pipeline in time, and truly eliminate all accidents in the budding state.

(4) In the present invention, when the intelligent switch safety valve mode is selected, the gas safety valve is automatically closed after the fire is used, which is able to realize the real-time automatic detection on gas pipeline leakage without the user's active participation such as timing. On the basis of the above third beneficial effect, the safety monitoring time of this mode is longer and more intelligent.

(5) In the system provided by the present invention, multiple private network communication modules are cooperated with the public network communication module, so that users or other relevant departments are able to remotely control the gas safety valve online, and at the same time master the status of the gas safety valve online, making up for the deficiencies that the existing technology is unable to allow users to remotely control and unable to remotely notify users of alarm information.

(6) The present invention is able to provide gas-related safety management departments with gas risk level data, so that based on these data, the gas-related safety management departments are able to reasonably arrange limited human and material resources to prioritize users with serious risks and high levels of danger. Therefore, the efficiency of relevant departments is improved, and the probability of gas safety accidents is greatly reduced.

(7) In the present invention, based on the Bernoulli principle, the gas safety valve actively controls the opening size of the motor valve and obtains the corresponding pressure, for judging whether there is flow in the gas pipeline, thereby helping the user to monitor whether the normal fire on the kitchen stove is extinguished unexpectedly in real time, and actively notify the user online remotely for dealing with in time.

(8) In the present invention, without using the user terminal, through quickly operating buttons on the multifunctional gateway, the system enables the user to realize the switch control of gas safety valve and the timing function, which greatly improves the user experience.

(9) In the present invention, the infrared array sensor is used to monitor temperature data of multiple locations on the kitchen stove, and the maximum temperature value in the temperature data received last time and this time is found through the data processing module, and then based on the maximum temperature value, it is judged whether there is a fire risk. According to the judgment result, it is determined whether the kitchen stove usage safety alarm information is sent to the multifunctional gateway, and whether the motor valve closing instruction is sent to the gas safety valve. The fire prevention alarm device is able to be not affected by the open flame generated by normal use of kitchen stoves and the smoke generated by normal cooking, is able to predict the fire in advance and notify the user to take corresponding measures, thereby reducing hidden fire hazards in the kitchen.

(10) In the present invention, the body recognition module is configured to detect whether there is a person in the kitchen or whether the person is in front of the kitchen stove, and send the detected data to the data processing module. The detected data are combined with the data monitored by the infrared array sensor for comprehensively calculation through the data processing module. When the difference between the two maximum temperature values is greater than the preset temperature difference threshold in the data processing module, if no one is in the kitchen or someone is in the kitchen but not in front of the kitchen stove, the alarm module issues an alarm directly; If someone is in the kitchen and in front of the kitchen stove, no alarm is issued. The operation adopts different treatment methods for different situations, and is reasonable in design.

(11) In the present invention, the environmental gas concentration in the kitchen is detected by the environmental detection module, and then the detected data are sent to the data processing module, the detected data are combined with other data for comprehensive calculation through the data processing module, which improves the accuracy of the fire prevention alarm device and avoids false alarms caused by the detection of a single sensor.

(12) In the present invention, when the kitchen stove in the kitchen is cooking, when it is detected that no one is in the kitchen, the data processing module automatically starts the timing unit integrated therein, and the timing unit starts to calculate the time when the user leaves the kitchen. When the user appears in the kitchen again, the data processing module automatically turns off the timing unit, and the timing unit stops calculation. Therefore, it is guaranteed that when the user does not actively participate in the timing, the timing unit is automatically started after the user leaves the kitchen. When no one appears in the kitchen after a certain period of time, the alarm module immediately gives an alarm to facilitate the timely notification to the user of the cooking work on the kitchen stove.

(13) In the present invention, the second power module provides two paths of power supply, wherein mains power supply is used as a main power supply and a rechargeable battery is used as an auxiliary power supply, so that when the mains power supply is cut off, the fire prevention alarm device is provided with emergency power supply through the rechargeable battery, which ensures that the fire prevention alarm device is able to normally monitor the state of the kitchen during the power cut.

BRIEF DESCRIPTION OF THE DRAWINGS

In order to more clearly illustrate technical solutions of embodiments of the present invention, the drawings used in the embodiments will be briefly described as below. It should be understood that the following drawings show only certain embodiments of the present invention and are therefore not considered as limiting the protective scope of the present invention. For those skilled in the art, other relevant drawings are also able to be obtained according to these drawings without any creative work.

Figure 1:
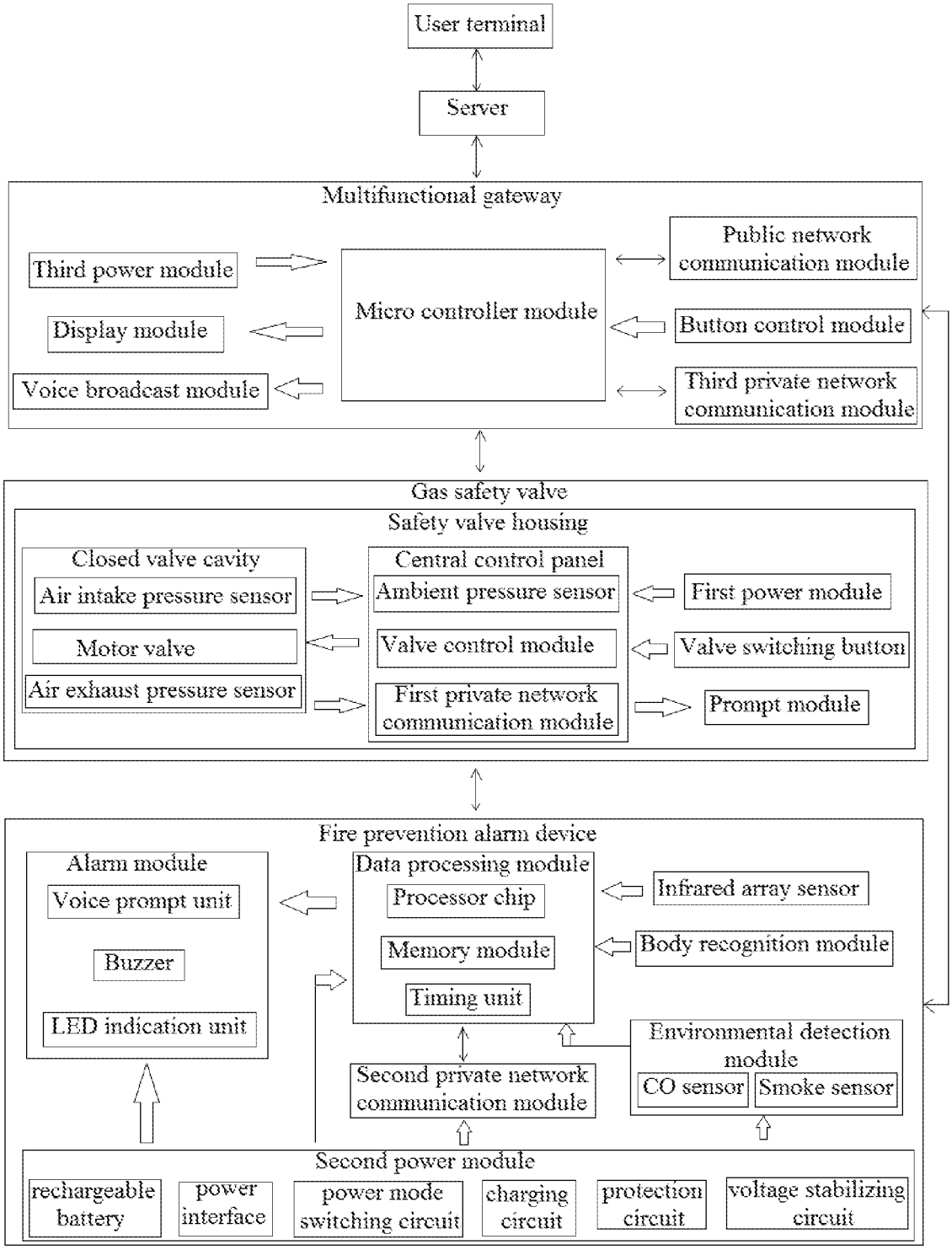
FIG. 1 is an overall structurally schematic view of an active kitchen safety monitoring system provided by the present invention.
Figure 2:
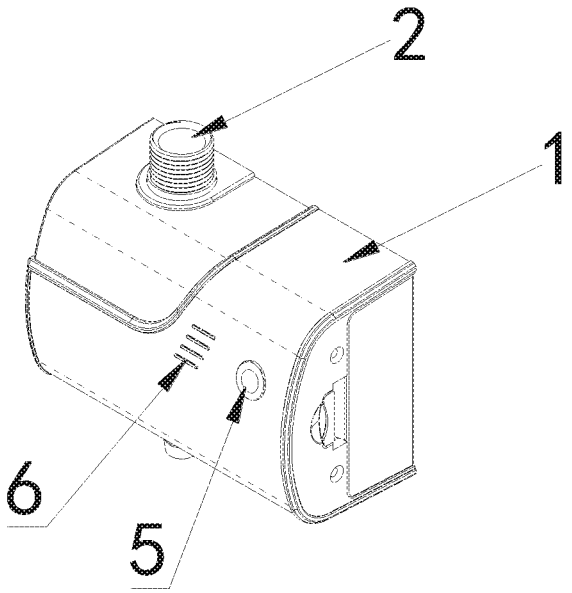
FIG. 2 is an overall structurally schematic view of a gas safety valve of the present invention.

In the drawings, 1: safety valve housing; 2: air intake port; 3: air exhaust port; 4: first power module; 5: valve switching button; 6: prompt module; 7: central control panel; 8: closed valve cavity; 9: leading-out hole; 10: seal joint.

DETAILED DESCRIPTION OF THE PREFERRED EMBODIMENT

In order to make the objectives, technical solutions and advantages of the present invention clearer, the present invention will be further described in detail as below with reference to the accompanying drawings and embodiments. It should be understood that the specific embodiments described herein are merely illustrative of the present invention and are not intended to limit the present invention, that is to say, the described embodiments herein are only a part of the embodiments of the present invention, but not all the embodiments. The components of the embodiments of the present invention, which are generally described and illustrated in the drawings herein, can be arranged and designed in a variety of different configurations. Therefore, the following detailed description of the embodiments of the present invention provided in the drawings is not intended to limit the protection scope of the present invention, but merely to show selected embodiments of the present invention. Based on the embodiments of the present invention, all other embodiments obtained by those skilled in the art without creative work will fall into the protection scope of the present invention.

It should be noted that the relational terms such as "first" and "second" are only used to distinguish one entity or operation from another entity or operation, and do not necessarily require or imply there is any such actual relationship or order between these entities or operations. Moreover, the terms "including", "comprising", and any other variations thereof are intended to encompass non-exclusive inclusion, such that a process, method, article, or device that comprises a series of elements comprises not only those elements but also comprises other elements not explicitly listed or inherent elements of the process, method, article, or device. Without more restrictions, the elements defined by the sentence "comprising a . . . " do not exclude the existence of other identical elements in the process, method, article, or device comprising the elements.

First Embodiment

Referring to FIG. 1 of the drawings, an active kitchen safety monitoring system according to a first preferred embodiment of the present invention is illustrated, which comprises a fire prevention alarm device, a gas safety valve, a multifunctional gateway, a server and a user terminal, wherein: the fire prevention alarm device, the gas safety valve and the multifunctional gateway are in communication connection with each other, the multifunctional gateway is connected with the user terminal through the server;

the fire prevention alarm device is configured to judge whether a kitchen stove has a fire risk based on real-time monitored temperature data of multiple locations on the kitchen stove, and then according to a judgement result, determine whether kitchen stove usage safety alarm information is sent to the multifunctional gateway and whether a motor valve close instruction is sent to the gas safety valve, and then send the real-time monitored temperature data to the multifunctional gateway;

the gas safety valve is configured to control a working state of a motor valve of the gas safety valve according to an internal pressure of a gas pipeline, send internal pressure data of the gas pipeline, working state information of the motor valve and gas usage safety alarm information to the multifunctional gateway, and simultaneously receive an instruction from the multifunctional gateway for daily timing or intelligently opening/closing the motor valve, wherein the gas usage safety alarm information comprises unexpected flameout, overpressure, underpressure, loose connection, hose breakage and hose falling of the gas pipeline;

the multifunctional gateway is configured to receive the temperature data, the internal pressure data of the gas pipeline, the working state information of the motor valve, the kitchen stove usage safety alarm information and the gas usage safety alarm information, send all of the received data and information to the user terminal through the server, and receive and execute an operation instruction from the user terminal;

the server is configured to store the temperature data, the internal pressure data of the gas pipeline, the working state information of the motor valve, receive and send the operation instruction from the user terminal, wherein the operation instruction comprises timing, opening the motor valve and closing the motor valve;

the user terminal is configured to view the temperature data collected by the fire prevention alarm device by a user, the internal pressure data of the gas pipeline, the working state information of the motor valve, the kitchen stove usage safety alarm information and the gas usage safety alarm information, and also configured to control the gas safety valve and the multifunctional gateway.

There are two modes for opening or closing the gas safety valve as follows:

(1) Timed automatic switch safety valve mode: in this mode, the gas safety valve is automatically closed at a daily automatic valve closing time set by the user, and then a leak detection is performed;

(2) Intelligent switch safety valve mode: in this mode, the gas safety valve intelligently determines whether a back end is using gas, so that the gas safety valve is automatically closed after ending gas consumption.

Second Embodiment

The gas safety valve comprises a safety valve housing 1, a closed valve cavity 8 is provided within the safety valve housing 1, an air intake port 2 and an air exhaust port 3 are provided on the closed valve cavity 8, a motor valve for communicating the air intake port 2 and the air exhaust port 3 is located within the closed valve cavity 8; a central control panel 7, a valve switching button 5 and a first power module 4 are located outside the closed valve cavity 8 and inside the safety valve housing 1; all of the motor valve, the valve switching button 5 and the first power module 4 are connected with the central control panel 7 through wires or FPCs (Flexible Printed Circuits).

The central control panel 7 is integrated with a first private network communication module, a valve control module and an ambient pressure sensor. The valve control module has timing detection function and flameout detection function, and is configured to control on/off of the motor valve, and according to data detected by an air exhaust pressure sensor, judge whether there is unexpected flameout, overpressure, underpressure, loose connection, hose breakage and hose falling of the gas pipeline exist.

According to the present invention, the first power module 4 is a lithium battery, an alkaline battery, a combination of the lithium battery and the alkaline battery, a combination of an adapter and the lithium battery, or a combination of the adapter and the alkaline battery. Each of the air intake pressure sensor, the air exhaust pressure sensor and the ambient pressure sensor is a BMP280 sensor or other absolute or differential pressure sensors, such as QMP6988 and MS5525.

Third Embodiment

The air intake pressure sensor and the air exhaust pressure sensor are provided within the closed valve cavity 8. The air intake pressure sensor, which is located at the air intake port 2 provided on the closed valve cavity 8, and is electrically connected with the central control panel. The air exhaust pressure sensor, which is located at the air exhaust port 3 provided on the closed valve cavity 8, and is electrically connected with the central control panel.

Fourth Embodiment

The gas safety valve further comprises a prompt module 6 for reminding the user of the current working state information of the motor valve and the usage state of the gas pipeline, wherein the current working state information of the motor valve and the usage state of the gas pipeline comprise the motor valve is opened, the motor valve is closed, insufficient power of the first power module 4, and loose connection, hose breakage, hose falling underpressure and overpressure of the gas pipeline. The prompt module 6 is connected with the central control panel 7 through wires or FPCs (Flexible Printed Circuits).

Figure 3:
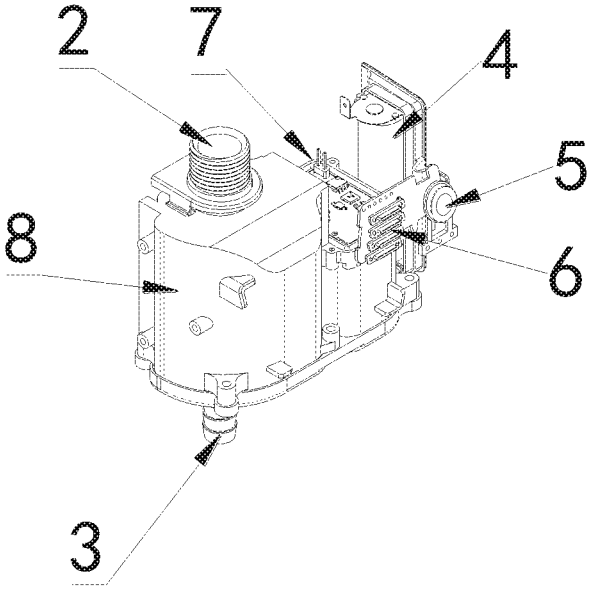
FIG. 3 is an internally structurally schematic view of the gas safety valve of the present invention.
Figure 4:
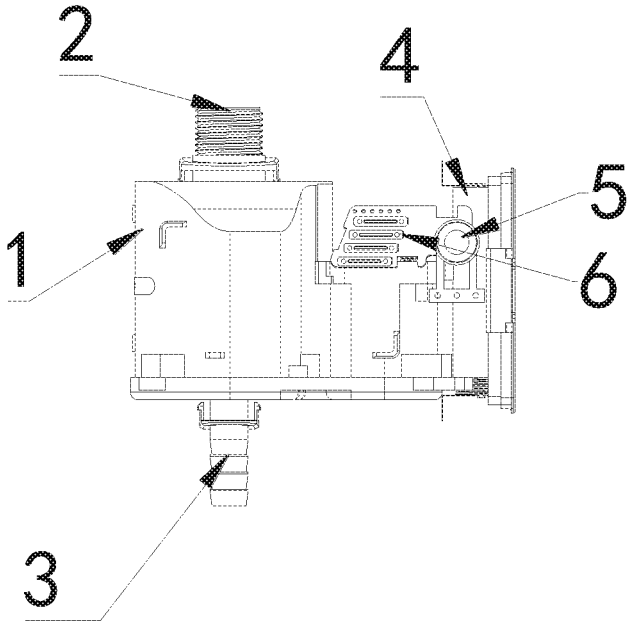
FIG. 4 is a front view of the gas safety valve of the present invention.
Figure 5:
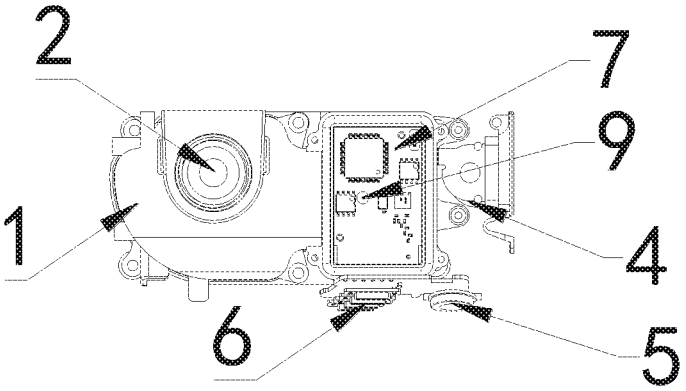
FIG. 5 is a top view of the gas safety valve of the present invention.
Figure 6:
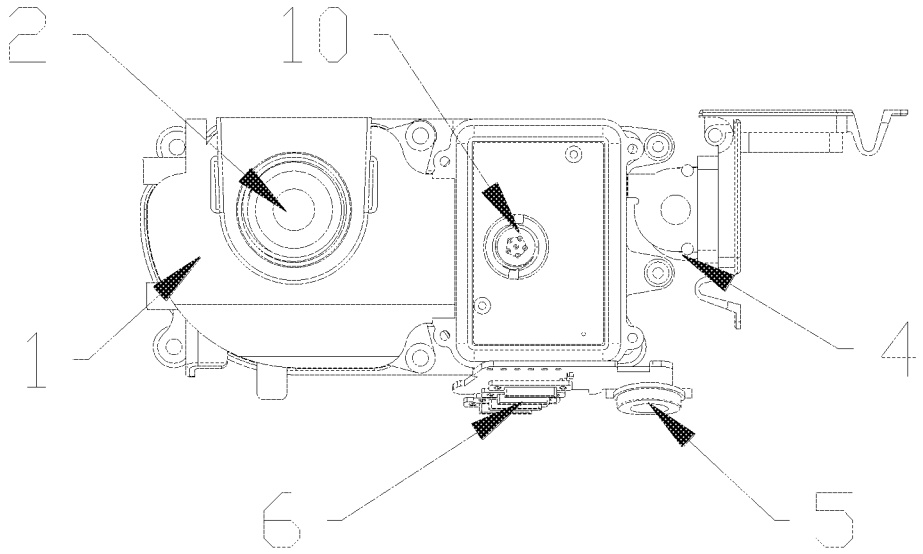
FIG. 6 is corresponding to FIG. 5 without a central control panel.

The prompt module 6 comprises four LED (light emitting diode) indicator lights with different colors, as shown in FIG. 3. When the user operates the gas safety valve, according to user operations, the current working state of the gas safety valve and the current state of the gas pipeline, the four LED indicator lights present different information as follows:

a yellow LED indicator light flashes, indicating that the current motor valve is opened;

a green LED indicator light flashes, indicating that the current motor valve is closed;

a blue LED indicator light flashes, indicating that the current lithium battery is low and needs to be replaced in time;

a red LED indicator light flashes, indicating that there is overpressure or underpressure in the gas pipeline.

All of the four LED indicator lights flash, indicating that there is a fault with the gas safety valve.

Through the LED indicator lights, the user is able to easily and accurately understand the current working state of the gas safety valve.

Fifth Embodiment

A leading-out hole 9 is provided on the closed valve cavity 8. A seal joint 10 is inserted into the leading-out hole 9. The wires of all of the air exhaust pressure sensor, the air intake pressure sensor and the motor valve are led out from the seal joint 10 and then connected with the central control panel.

Sixth Embodiment

The fire prevention alarm device comprises a second power module for providing various components thereof with power, a second private network communication module for connecting the multifunctional gateway with the gas safety valve, an alarm module, an infrared array sensor for monitoring the temperature data at the several locations on the kitchen stove in real time and sending the temperature data monitored to a data processing module, the data processing module for receiving the temperature data monitored by the infrared array sensor, sending to the multifunctional gateway, respectively finding two maximum temperature data $T_{max1}$ and $T_{max2}$ in the temperature data received both before and after, judging whether the kitchen stove has the fire risk based on a difference between $T_{max1}$ and $T_{max2}$, alarming through the alarm module if the kitchen stove has the fire risk, sending the kitchen stove usage safety alarm information to the multifunctional gateway and sending the motor valve close instruction to the gas safety valve.

The infrared array sensor is selected from but not limited to MLX90621, MLX90640 and AMG8853. The alarm module comprises a voice prompt unit, a buzzer and an LED indication unit.

The second power module comprises a rechargeable battery, a power interface, a power mode switching circuit, a charging circuit, a voltage stabilizing circuit and a protection circuit, wherein the power interface is connected with a mains power supply through the protection circuit. The mains power supply is connected with the rechargeable battery through the protection circuit and the charging circuit, the rechargeable battery is connected with the power interface through the power mode switching circuit, the power interface is connected with the voltage stabilizing circuit, a power supply voltage is converted into a voltage required by the fire prevention alarm device through the voltage stabilizing circuit, the rechargeable battery is a lithium battery.

The fire prevention alarm device is installed on a suspended ceiling of a kitchen, and the kitchen stove is located in a middle of a view field of the infrared array sensor. The fire prevention alarm device comprises the second power module for providing various components thereof with power, the second private network communication module for connecting the multifunctional gateway with the gas safety valve, the alarm module, the infrared array sensor, and the data processing module, wherein:

the infrared array sensor is configured to monitor the temperature data at 64 locations on the kitchen stove and room temperature in real time, and send the temperature data monitored to the data processing module every time, wherein the infrared array sensor is selected from but not limited to MLX90621, MLX90640 and AMG8853;

the data processing module comprises a processor chip and a memory module, wherein the processor chip adopts STM32F030CC, and the memory module adopts SST26VF032; the data processing module for receiving the temperature data monitored by the infrared array sensor, sending to the multifunctional gateway, respectively finding two maximum temperature data $T_{max\ 1}$ and $T_{max2}$ in the temperature data received both before and after, judging whether the kitchen stove has the fire risk based on a difference between $T_{max1}$ and $T_{max2}$, alarming through the alarm module if the kitchen stove has the fire risk, sending the kitchen stove usage safety alarm information to the multifunctional gateway and sending the motor valve close instruction to the gas safety valve;

the alarm module comprises the voice prompt unit, the buzzer and the LED indication unit;

the second power module comprises a rechargeable battery, a power interface, a power mode switching circuit, a charging circuit, a voltage stabilizing circuit and a protection circuit, wherein the power interface is connected with a mains power supply through the protection circuit. The mains power supply is connected with the rechargeable battery through the protection circuit and the charging circuit, the rechargeable battery is connected with the power interface through the power mode switching circuit, the power interface is connected with the voltage stabilizing circuit, a power supply voltage is converted into a voltage required by the fire prevention alarm device through the voltage stabilizing circuit, the rechargeable battery is a lithium battery. When the mains power is cut off, the fire prevention alarm device is powered by the rechargeable battery to ensure that the fire prevention alarm device is able to normally monitor the state of the kitchen during a power cut. The power mode switching circuit is configured to control the switching between a main power supply and an auxiliary power supply. The charging circuit is configured to automatically charge the rechargeable battery when the mains power supply is normal. The protection circuit is configured to prevent the internal circuit of the second power module from being damaged when a positive electrode and a negative electrode of the power supply are reversed.

The fire prevention alarm device is configured to judge whether the kitchen stove has the fire risk based on the real-time monitored temperature data of the multiple locations on the kitchen stove, and then according to judgement results, determine whether the kitchen stove usage safety alarm information is sent to the multifunctional gateway and whether the motor valve close instruction is sent to the gas safety valve, and then send the real-time monitored temperature data to the multifunctional gateway.

Seventh Embodiment

The fire prevention alarm device further comprises a body recognition module for detecting human signals in the kitchen, and an environmental detection module for detecting gas concentration in the kitchen, wherein both the body recognition module and the environmental detection module are connected with the data processing module.

The body recognition module is selected from but not limited to PIR (Polyisocyanurate Foam) pyroelectric infrared sensor, a body detection radar, an ultrasonic module, an infrared or laser ranging module. The environmental detection module is at least one member but not limited to a methane sensor, a CO sensor and a smoke sensor.

When the calculation result of the temperature data collected by the central control panel through the infrared array sensor is abnormal, the processor chip performs corresponding processing according to human body data detected by the PIR pyroelectric infrared sensor. If the PIR pyroelectric infrared sensor detects that no one is in the kitchen or someone is in the kitchen but is not in front of the kitchen stove, then the alarm module directly issues an alarm; if PIR pyroelectric infrared sensor detects that there is someone in the kitchen and is in front of the kitchen stove, no alarm is issued.

The environmental detection module comprises a CO sensor and a smoke sensor. Through the CO sensor and the smoke sensor, the gas concentration in the kitchen is obtained and sent to the processor chip, and then is comprehensively calculated by the processor chip to obtain a correct calculation output, which avoids false alarms caused by using a single ion device, thereby improving the alarm accuracy of the fire prevention alarm device.

When a difference between the maximum temperature of the monitored temperature data every time and the room temperature is less than 5° C., the internal pressure of the gas pipeline is normal, the CO concentration is maintained at a normal CO concentration in the air (namely, less than 0.5 ppm), the duration of this state exceeds 3 min, which means that there is leakage risk in the gas pipeline, so that the alarm module issues an alarm, namely, the voice prompt unit reminds the user that there is leakage risk in the gas pipeline, the buzzer sounds, the LED indicator lights change from a normal state to an abnormal state. At the same time, the fire prevention alarm device sends the motor valve close instruction to the gas safety valve through the second private network communication module, the valve control module receives the motor valve close instruction to close the motor valve, for preventing gas from continuous leakage, thereby avoiding safety accidents.

When the difference between the maximum temperature of the monitored temperature data every time and the room temperature is less than 5° C., the internal pressure of the gas pipeline is normal, the CO concentration is significantly higher than 0.5 ppm and has a clear upward trend, and tends to be stable at a value higher than 0.5 ppm, the duration of this state exceeds 10 min, which means that the infrared array sensor may be damaged or the kitchen stove is not within the measurable range of the infrared array sensor. Accordingly, the alarm module issues an alarm, namely, the buzzer sounds, the LED indicator lights change from the normal state to the abnormal state, the prompt unit reminds the user that whether the kitchen stove is within the measurable range of the infrared array sensor. If it is determined that the kitchen stove is within the measurable range of the infrared array sensor, the user is reminded that the infrared array sensor may be damaged and needs to be replaced.

Eighth Embodiment

The fire prevention alarm device further comprises a timing unit, wherein the timing unit, which is configured to calculate the time that the user leaves the kitchen during cooking, is integrated within the data processing module. A time threshold set in the data processing module is recorded as S. When the kitchen stove in the kitchen is cooking, if it is detected that there is no one in the kitchen, the data processing module automatically starts the timing unit integrated therewith, and the timing unit starts to calculate the time when the user leaves the kitchen; during the time S, if the user never appears in the kitchen, the processor chip actively issues the alarm through the warning module, and reminds the user to perform timely processing through the user terminal. Under the premise that the timing unit is activated, if the user appears in the kitchen again during the time S, the data processing module automatically closes the timing unit, so that the timing unit stops calculation. At the same time, the user is able to change the time threshold S through the user terminal. For example, in case of longer cooking time, the user is able to change the time threshold from 30 min to 1 h. The kitchen timer in the prior art needs to be manually turned on or off, and also needs to be manually operated in time setting, which is unable to fundamentally solve hidden safety problems caused by forgetting to turn off the kitchen stove. Obviously, the present invention is able to solve the above problem.

Ninth Embodiment

The multifunctional gateway comprises a third power module, a micro controller module, a third private network communication module for connecting with the gas safety valve and the fire prevention alarm device, a public network communication module for connecting with the server, a display module and a button control module.

The display module is able to be a segment LCD display, an LED display, a TFT display or an OLED display for displaying the current real-time clock information, the network state, the working state information of the motor valve, and the state information of the third power module.

Tenth Embodiment

The multifunctional gateway further comprises a voice broadcast module for reminding the user of related information of the gas safety valve and the multifunctional gateway.

The voice broadcast module is configured to play corresponding audio contents as required, such as overpressure valve closing prompt, underpressure valve closing prompt, fire on the kitchen stove is accidentally extinguished, the current motor valve is opened, the current motor valve is closed, time is up, loose gas pipeline interface and risk of hose breakage.

Eleventh Embodiment

The button control module comprises 7 control buttons, which are respectively as follows:

an ignore button, wherein the alarm is stopped by pressing the ignore button under abnormal alarm states;

a valve control button for changing the working state of the current motor valve;

five selection buttons for respectively setting hours, ten minutes, minutes of timing, resetting and starting to control the on/off of the motor valve of the gas safety valve by the user.

The multifunctional gateway comprises the third power module, the micro controller module, the third private network communication module for connecting with the gas safety valve and the fire prevention alarm device, the public network communication module for connecting with the server, the display module and the button control module, wherein the third power module, which adopts the dual backup power supply mode, comprises an ACDC conversion module for converting mains power (such as AC power in a range of 90 V to 265 V) into a 5V direct current which is able to be used in the system, and a lithium battery. When the user needs to move the multifunctional gateway to any convenient place for use, the built-in spare lithium battery is used for power supply. After use, the user is able to plug the AC pin port of the multifunctional gateway into the power supply socket of the mains power supply, so as to provide power for the mains power supply and charge the lithium battery. The display module uses a segment LCD display screen for displaying the current real-time clock information, network status, working status of gas safety valve, and status information of the third power module. The button control module comprises seven touch control buttons which are respectively as follows:

one ignore button for stopping alarm under abnormal alarm state;

one valve control button for changing the working status of motor valve, wherein while pressing the valve control button, the motor valve opening instruction or the motor valve closing instruction is sent to the gas safety valve through the third private network communication module of the multifunctional gateway, the gas safety valve makes corresponding actions;

five selection buttons which are respectively hour button, ten-minute button, and minute button three of which are configured to set time, clear button and start button, wherein five selection buttons are configured to control on/off the motor valve of the gas safety valve. After setting the timing time and pressing the start button, the multifunctional gateway starts timing and displays the time synchronously on the user terminal. As soon as the timing time expires, the multifunctional gateway and the user terminal simultaneously remind the user. If the user does not handle the timeout, the gas safety valve is automatically closed to avoid safety accidents.

The multifunctional gateway is configured to receive the temperature data, the internal pressure data of the gas pipeline, the working state information of the motor valve, the kitchen stove usage safety alarm information and the gas usage safety alarm information, send all of the received data and information to the user terminal through the server, and receive and execute an operation instruction from the user terminal.

The server is connected with the multifunctional gateway and the user terminal through the public network communication module, and is configured to store the temperature data, the internal pressure data of the gas pipeline and the working state information of the motor valve, receive and send the operation instruction from the user terminal, wherein the operation instruction comprises timing, opening the motor valve and closing the motor valve.

An application APP connected to the server is installed on the user terminal, and the user views related information through the APP and sends operation instructions to the server for controlling the gas safety valve and the multifunctional gateway. The relevant information viewed by the user comprises the temperature data collected by the fire prevention alarm device, the internal pressure data of the gas pipeline, the working status information of the motor valve, the gas usage safety alarm information and the kitchen stove usage safety alarm information.

The working principle of the system provided by present invention is as follows.

The working status information of the motor valve, the temperature data monitored in real time, the internal pressure data of the gas pipeline, the kitchen stove usage safety alarm information and the gas usage safety alarm information are timely sent to the third private network communication module of the multifunctional gateway through the first private network communication module or the second private network communication module, and then sent to the server through the public network communication module of the multifunctional gateway, and then the data received by the server are displayed on the user terminal in real time through the public network communication module.

When there is the gas usage safety alarm information that needs to be notified to the user, it is firstly sent to the second private network communication module of the multifunctional gateway through the first private network communication module, then is sent to the server through the public network communication module of the multifunctional gateway, and then the server issues an alarm at the user terminal through the public network communication module, thereby notifying the user. The method of dealing with the kitchen stove usage safety alarm information is similar to that of dealing with the gas usage safety alarm information. When there is the kitchen stove usage safety alarm information, the motor valve closing instruction is sent by the data management module of the fire prevention alarm device to the first private network communication module of the gas safety valve through the second private network communication module, the gas safety valve receives the motor valve closing instruction and makes corresponding actions.

When the user needs to view or operate the gas safety valve or the multifunctional gateway, the application APP of the user terminal is opened to execute a corresponding action, a corresponding instruction from the user is sent to the server; after receiving the instruction, the server sends the instruction to the multifunctional gateway through the public network communication module, the multifunctional gateway judges the instruction is a timing start instruction, a motor valve opening instruction or a motor valve closing instruction. If being a motor valve opening instruction, the instruction is sent to the first private network communication module of the gas safety valve through the third private network communication module. The gas safety valve receives a corresponding instruction and makes a corresponding treatment. If the instruction is a timing start instruction, the multifunctional gateway begins to timing according to a timing time set by the user and the time is synchronously displayed on the user terminal. Moreover, the user is also able to control the fire prevention alarm device through the user terminal. For example, the working status of the alarm module of the fire prevention alarm device is controlled. The method of controlling the fire prevention alarm device is similar to that of controlling the gas safety valve, which specifically comprises sending related instructions to the fire prevention alarm device through the server and the multifunctional gateway in turn.

Twelfth Embodiment

A control method of the active kitchen safety monitoring system mentioned above is described as follows, wherein the control method is performed at the intelligent switch safety valve mode and comprises steps of:

(S1) when the motor valve is closed, obtaining a pressure value Pe1 collected by the ambient pressure sensor and a pressure value Po1 collected by the air exhaust pressure sensor, and obtaining a relative pressure Pob1 at the air exhaust port, wherein Pob1=Po1−Pe1;

(S2) when the motor valve is closed and the user presses a fire button of the kitchen stove to ignite, obtaining a pressure value Pe2 collected by the ambient pressure sensor and a pressure value Pot collected by the air exhaust pressure sensor, and obtaining a relative pressure Pob2 at the air exhaust port, wherein Pob2=Po2−Pe2 and Pob2=0 at this time;

(S3) when the central control panel detects Pob2 is instantaneously reduced to 0, opening the motor valve after a delay of 1 second, and then closing the gas safety valve after a delay of 1 second, and then obtaining a pressure value Pe3 collected by the ambient pressure sensor and a pressure value Po3 collected by the air exhaust pressure sensor after a delay of 1 second, and finally obtaining a relative pressure Pob3 at the air exhaust port, wherein Pob3=Po3−Pe3; and (S4) respectively judging a relationship between Pob3 and Pob1, and a relationship between Pob3 and Pob2, wherein:

if Pob3 is close to Pob1, it is a fact that the user presses the fire button of the kitchen stove to ignite, the central control panel controls the motor valve to be automatically opened, so that the user normally uses the kitchen stove;

if Pob3 is close to Pob2, namely, Pob3 is close to 0, then (S3) is repeated after a delay of 1 second to obtain a relative pressure Pob3' for re-judgement, when an amount of repetitions exceeds 5 times, and Pob3' is always close to Pob2, it is considered that the gas pipeline is fallen off or damaged, the motor valve is closed and pipeline failure is reported through the first private network communication module;

when Pob3' is close to Pob1 during re-judgement, the central control panel controls the motor valve to be automatically opened.

The principle of the above method is as follows. When the user presses the fire button for the first time, the motor valve is opened to replenish pressure for the rear-end pipeline, so as to allow a pressure of the rear-end pipeline to reach a normal supply pressure. At this time, the relative pressure monitored at the air exhaust port Pob3 is close to Pob1, so that it is judged that the user needs fire. The central control panel directly controls the motor valve to be opened, the user restores the fire button and then re-ignites. Accordingly, the motor valve is opened, and the user is able to use gas normally.

However, if the pipeline of the gas safety valve falls off or breaks, after being opened for 1 second, the motor valve is closed and the rear-end pipeline is inflated. The inflated gas will quickly leak out, so the relative pressure Pob3' measured at the air exhaust port after the delay of 1 s is still close to 0. After being repeatedly tested for 5 times, the pressure value measured at the air exhaust port is still 0, then it is able to be judged that the rear-end pipeline is falling off or damaged. Accordingly, the motor valve is closed and pipeline failure is reported through the first private network communication module.

While distinguishing the user's gas demand, the rear-end pipeline is falling off or damaged, the core is that when the user uses gas, the fire button of the kitchen stove is pressed for first time, no fire is produced, the user will restore the fire button. While restoring, the rear-end pipeline is sealed, the supplemental gas will not be leaked out; and however, when the pipeline is falling off or damaged, the rear end is no longer sealed, and it will never be possible to maintain the normal pressure value when the motor valve is closed.

Thirteenth Embodiment

A control method of the active kitchen safety monitoring system mentioned above is described as follows, wherein the control method is performed at timed automatic switch safety valve mode and comprises steps of:

(S5) defining a self-check time period and a detection frequency of the gas safety valve, and automatically closing the motor valve by the valve control module during the defined self-check time period;

(S6) after closing the motor valve, through the air exhaust pressure sensor, obtaining a gas pressure value $P_b$ within a segment of the gas pipeline between the motor valve and a kitchen stove in real-time, wherein if the segment of the gas pipeline is in an absolutely sealed state, there will be no downward trend in the gas pressure value $P_b$, and the segment of the gas pipeline will always be under steady pressure; if there is a loose connection in the gas pipeline or a hose is broken or the hose is falling off, there will be a downward trend in the gas pressure value $P_b$, and the gas pressure value $P_b$ will drop to an atmospheric pressure value $P_a$ of an external environment, which means that there is the loose connection in the gas pipeline or the hose is broken or the hose is falling off; and (S7) while determining there is the loose connection in the gas pipeline or the hose is broken or the hose is falling off, immediately closing the motor valve, sending an alarm to the third private network communication module of the multifunctional gateway through the first private network communication module, sending an instruction to the server through the public network communication module of the multifunctional gateway, and notifying the user terminal through networks.

A method for judging whether there is underpressure or overpressure in the gas pipeline comprises steps of:

(A1) after installing the gas safety valve, powering each electronic element of the gas safety valve with the first power module 4 for making internal circuits of the gas safety valve work normally, the valve control module obtaining a pressure value from the air exhaust pressure sensor, and recording the pressure valve as $P_a$, wherein the pressure valve is the atmospheric pressure value of the environment where the gas safety valve is currently located;

(A2) the valve control module obtaining another pressure value from the air exhaust pressure sensor every certain interval, recording the another pressure value as $P_b$, wherein the another pressure value is the gas pressure value in the gas pipeline; and (A3) comparing $P_a$ with $P_b$, wherein if $P_b-P_a>P_u$, there is overpressure in the gas pipeline, the user is reminded through the user terminal; if $P_b-P_a<P_l$, there is underpressure in the gas pipeline, the user is also reminded through the user terminal, here, $P_u$ and $P_l$, respectively represent a pressure upper limit value and a pressure lower limit value which are preset by the valve control module.

A method for judging whether unexpected flameout occurs during normal use of fire comprises steps of:

(B1) activating a flameout detection function of the gas safety valve through the user terminal:

(B2) adjusting a valve opening size of the motor valve every interval m, and simultaneously obtaining the gas pressure value $P_b$ at this time in the gas pipeline through the air exhaust pressure sensor; and (B3) based on Bernoulli principle, judging whether current fire on the kitchen stove is burning normally or the fire has been extinguished unexpectedly according to the gas pressure value $P_b$, wherein if it is judged that the fire has extinguished unexpectedly, the user is reminded through the user terminal.

A method of judging whether there is loose connection, hose breakage or hose falling in the gas pipeline comprises steps of:

after the motor valve is closed, through the air exhaust pressure sensor, obtaining the gas pressure value $P_b$ in a segment of the gas pipeline between the motor valve and the kitchen stove in real time, wherein if there is no downward trend in the obtained gas pressure value $P_b$, the segment of the gas pipeline between the motor valve and the kitchen stove is intact; if the obtained gas pressure value $P_b$ shows the downward trend and falls to the atmospheric pressure value $P_a$ of the external environment within a certain period of time, there is loose connection, hose breakage or hose falling in the segment of the gas pipeline, the user is reminded through the user terminal.

An input end of the gas safety valve is connected with a ball valve at a rear end of a gas meter, and an output end of the gas safety valve is connected with a bellow or a hose.

The central control panel 7 collects the pressure data from the air intake pressure sensor, the air exhaust pressure sensor and the ambient pressure sensor through I2C signals. The valve switching button 5 is configured to directly control switching on/off of the motor valve. The central control panel 7 is integrated with a power conversion module, the first private network communication module and the valve control module with timing detection function and flameout detection function. The valve control module is configured to control on/off of the motor valve, and according to data detected by the air intake pressure sensor, the air exhaust pressure sensor and the ambient pressure sensor, judge whether there is unexpected flameout, overpressure, underpressure, loose connection, hose breakage and hose falling of the gas pipeline.

Fourteenth Embodiment

Preferably, a control method of the active kitchen safety monitoring system further comprises intelligently closing the gas safety valve which comprises steps of:

(S8) when the motor valve is opened and the fire continues on the kitchen stove, obtaining a pressure value Pi4 collected by the air intake pressure sensor and a pressure value Po4 collected by the air exhaust pressure sensor, and obtaining a relative pressure between the air intake port and the air exhaust port Pio4=Pi4−Po4;

(S9) when the motor valve is opened and no fire on the kitchen stove, obtaining a pressure value Pi5 collected by the air intake pressure sensor and a pressure value Po5 collected by the air exhaust pressure sensor, and obtaining a relative pressure between air intake port and the air exhaust port Pio5=Pi5−Po5; and (S10) obtaining a pressure loss Pd=Pio4−Pio5, considering that the user turns off the kitchen stove is a fact when the Pd is close to a threshold value N and the central control panel completes valve closing detection after a delay of t, and closing the motor valve.

It is assumed that when the current flow rate of the kitchen stove with one burner fully opened is about 0.6 $m^3/h$, that is, the relative pressure Pio4 between the air intake port and the air exhaust port is measured when one burner is fully opened, if the pressure loss Pd=Pio4−Pio5 is M, when one burner changes from being fully opened to slowly lowered, Pd is lowered from M; finally, when the kitchen stove is turned off, Pd is about zero; at this time, it is able to be judged that an operation that the user turns off the kitchen stove is a fact. Since the temperature and pressure sensor itself has a certain error, in actual design, the threshold value for judging that the user may have turned off the kitchen stove is N, that is, when Pd is smaller than N, it is judged that the kitchen stove may be turned off, but the motor valve is not immediately turned off. The reason is that according to actual cooking habits, the kitchen stove may occasionally be turned on and off during a meal, so the function of closing the motor valve after a delay of t is set.

Furthermore, when the user uses the minimum fire for cooking, the pressure loss Pd at the minimum fire may not be much different from the pressure loss at the time of turning off the kitchen stove, or may be lower than N. If the motor valve is closed at this time, the user's normal cooking may be affected. Therefore, it is necessary to determine whether the user is actually turning off the kitchen stove or using the minimum fire for cooking at this time. The motor valve is closed when the kitchen stove is really turned off, and the gas safety valve is not closed for the minimum fire cooking. As a result, a valve closing monitoring process is set. At the same time, in order to accurately judge, the air exhaust port of the present invention is set to be a triangle, which makes the flow area of the motor valve change nonlinearly during the gradual closing of the motor valve, so that it is able to avoid misjudgment while determining the kitchen stove is turned off or the kitchen stove is in low fire cooking state. Since the gas flow rate is also very low when the user cooks with the minimum tire, if the gas flow area changes linearly during the valve closing process, it is easy to misjudge the user's cooking behavior with the minimum fire as the user turning off the kitchen stove.

Fifteenth Embodiment

Preferably, a control method of the active kitchen safety monitoring system further comprises a motor valve closing detection process which comprises steps of:

(S11) when Pd is close to the threshold valve N and the delay time t has expired, the central control panel controlling the motor valve to slowly turn off, wherein the motor valve is gradually closed to a certain degree and stays for some time after being closed to the certain degree every time, Pd' is obtained; and (S12) judging a variation tendency of Pd', wherein:

if Pd' is larger than the threshold value M, it is considered that at this time, there is a small flow of gas circulation, the user is using the minimum fire, this test is over, and the motor valve is fully opened;

if the motor valve is gradually closed till the motor valve is fully closed, Pd' is always lower than the threshold value N, it is considered that at this time, an operation that the user turns off the kitchen stove is a fact, so that it is determined that the motor valve is turned off.

Specially, when Pd is lower than N and the time delay t has expired, the motor valve closing detection process is activated, that is, the motor valve is slowly closed and gradually closed to a certain degree, and stays for some time after being closed to the certain degree every time, a new pressure loss Pd' is obtained; an then a variation tendency of Pd' is judged, wherein: if in the process of slow valve closing, Pd' has a gradual increase trend and Pd' is greater than M, it is considered that there is a small flow, and the motor valve is fully opened, this test is completed, the motor valve is unable to be closed. If the gas safety valve is gradually closed till the gas safety valve is fully closed, there is no trend of increasing Pd' and Pd' is always not higher than the threshold value N, the gas safety valve is directly closed and has no need to be opened, and it is judged that at this time, the user really turns off the kitchen stove, thereby completely avoiding the situation of accidentally turning off the kitchen stove and affecting the user's normal cooking.

Preferably, the threshold value N is 30 Pa, the threshold value M is 50 Pa, the time t is 10 min.

In order to facilitate the related departments to reasonably arrange personnel to investigate and deal with safety accidents, to give priority to greater safety risks, to avoid gas safety accidents, the time T of the gas pressure value in the gas pipeline falling to the pressure value of the external atmosphere is recorded. The security risk level is determined according to the time T The smaller the value of time T, the higher the security risk level. Conversely, the greater the value of time T, the lower the security risk level. If the value of time Tis infinite, it means normal and there is no security risk.

According to the present invention, the security risk level is initially divided into four levels as follows (which is also able to be adjusted according to actual situations):

if T≤10 s, then it means that there is a significant security risk;

if 10 s<T≤30 s, then it means that there is a greater security risk;

if 30 s<T≤300 s, then it means that there is a general security risk;

if T>300 s, then it means there is no security risk.

According to the requirements for safe use of gas, the user should close the gas safety valve to ensure safety after using the kitchen stove, and then open the gas safety valve again while using it next time. However, in the case of existing mechanical ball valves or mechanical self-closing valves, most users will not or often forget to actively close the ball valve after using the kitchen stove, because the ball valve must be manually opened before firing and manually closed after completing cooking every time, some of the ball valves are far away from the kitchen stove, which is inconvenient for the users; some users have not developed such a habit or do not know it is necessary to be safe. The system provided by the present invention is able to automatically close and open the motor valve regularly according to the time set by users, that is, the motor valve of the system is automatically closed every day without users knowing it, so as to detect loose connection and hose breakage of the gas pipeline. When the fire is to be used again the next day, the motor valve has been opened at the set automatic valve opening time. Obviously, there is no need for users to manually open the motor valve, which saves time and improves efficiency for users, thereby providing users with the best experience under the premise of ensuring maximum safety. At the same time, it also guarantees that families with the system provided by the present invention are able to actively protect to the same extent regardless of how much they know about the gas safety usage regulations, without having to be different due to different user habits and how much they know about gas safety knowledge.

The user is able to start the flameout detection function of the kitchen stove at any time through the application APP, so as to prevent the user from accidentally extinguishing fire during long-term use of fire (such as cooking soup), resulting in the failure to complete the normal cooking. A specific method for judging whether there is an unexpected flameout during normal fire usage comprises steps of:

the gas safety valve receiving a flameout detection request and detecting whether flameout accidentally occurs during normal fire in a time period set by the user. Due to the normal use of fire on the kitchen stove, there will be a continuous flow in the gas pipeline, that is, the gas in the gas pipeline flows at a certain speed towards the air exhaust port 3. According to Bernoulli equation:

$$p+\rho gh+(1/2)*\rho v^2=C,$$

here, p, ρ and μ are respectively pressure, density and speed of fluid, h is vertical height, g is acceleration of gravity, C is constant. According to Bernoulli principle, it is able to be known that the pressure is low at high flow velocity, and the pressure is high at low flow velocity, that is, during the gas flow in the gas pipeline, the gas velocity is low and the pressure is high where the diameter of the gas pipeline is large, and the gas velocity is fast and the pressure is low where the diameter of the gas pipeline is small. Therefore, under the existing structure of the present invention, when the opening size of the motor valve is small, the speed of gas with the same flowing through here is faster, then the gas pressure here is smaller and vice versa. Through intelligently adjust the opening size of the motor valve where the gas flows through, it is detected that whether the fire on the kitchen stove is extinguished unexpectedly.

The opening size of the motor valve is regularly controlled, and the gas pressure value Pb in the gas pipeline is regularly detected. When it is found that the opening size of the motor valve is reduced, the gas pressure value Pb obtained from the air exhaust pressure sensor is also reduced. When the opening size of the motor valve is increased, the gas pressure value Pb obtained from the air exhaust pressure sensor is also increased. Accordingly, it is able to be concluded that the fire on the kitchen stove is burning normally. When it is found that the motor valve has different opening sizes, the gas pressure values Pb obtained from the air exhaust pressure sensor are equivalent, indicating that there is no fire at this time, and the fire on the kitchen stove has been extinguished unexpectedly. Therefore, an notification is sent to the third private network communication module of the multifunctional gateway through the first private network communication module, the notification is uploaded to the server through the public network communication module of the multifunctional gateway, and then is displayed on the user terminal through internets after the server receiving the notification, so as to facilitate the user handling in time to avoid affecting the user's normal meal time.

The temperature values of 64 locations on the kitchen stove and the room temperature every 5 s for once are collected by an infrared matrix sensor, and the temperature values of the 64 locations obtained last time and this time. A preset temperature difference threshold value in the data processing module is recorded as D. The maximum temperature value of the temperature values of the 64 locations obtained last time is recorded as $T_{max1}$, and the maximum temperature value of the temperature values of the 64 locations obtained this time is recorded as $T_{max2}$. According to this embodiment, the temperature difference threshold value D is set to 20° C. Then, when $T_{max2}-T_{max1}>20°$ C., it is considered abnormal. When the food in the pot is not dried, the pot is kept in a certain temperature range by vaporizing water. When the water in the pot is dried, the pot is unable to be kept in a certain temperature range by vaporizing water, the temperature of the pot rises sharply, so that the temperature rises rapidly beyond 20° C. within 50 seconds. Therefore, when the difference between the two maximum temperature values of last time and this time exceeds 20° C., it is considered that the pot is dried, and an alarm signal is immediately sent to the alarm module, so that the buzzer issues the alarm, the voice prompt unit prompts a voice, the LED indication unit is switched from the normal state to the alarm state, and the user is timely notified of dangerous situations for dealing with dangerous situations as soon as possible. However, at this time, there is no fire hazard in the kitchen, thus preventing the fire hazard. Simultaneously, through analyzing the temperature values obtained by the infrared matrix sensor, the fire prevention alarm device is able to judge whether there is someone in front of the kitchen stove.

The working principle of each component of the system provided by the present invention is as follows.

After installing the gas safety valve, the motor valve is in the closed state. After installing the lithium battery for the gas safety valve for the first time, the internal components of the gas safety valve work normally. The central control panel obtains a pressure value from the air exhaust pressure sensor. This pressure value is the atmospheric pressure value of the environment where the gas safety valve is currently located and denoted as Pa. The atmospheric pressure value Pa is stored in the EEPROM inside the valve control module. After replacing the battery and powering on again, there is no need to regain this value.

After the user opens the motor valve by pressing the valve switching button 5, the valve control module obtains a pressure value measured by the air intake pressure sensor every certain interval (for example, 5 s). This pressure value is the gas pressure value in the current gas pipeline and is recorded as Pb. When the difference between the gas pressure value Pb in the gas pipeline and the atmospheric pressure value Pa exceeds the pressure upper limit value Pu preset by the valve control module, it means that the gas pipeline is overpressure, the motor valve is firstly closed, and then an alarm is issued through the user terminal. When the difference between the gas pressure value Pb in the gas pipeline and the atmospheric pressure value Pa is lower than the pressure lower limit value Pl preset by the valve control module, it means that the gas pipeline is under pressure, the motor valve is also firstly closed, and then an alarm is issued through the user terminal. In this embodiment, the pressure upper limit value Pu is 8 KPa±2 KPa, and the pressure lower limit value Pl is 800 Pa±200 Pa.

When the user presses the valve switching button 5, the central control panel 7 obtains a low-level signal; and when the user releases the valve switching button 5, the central control panel 7 obtains a high-level signal, thereby judging whether the valve switching button is pressed or released. When the central control panel 7 detects that the user presses the valve switching button 5, the central control panel 7 performs switching between opening the motor valve and closing the motor valve. When switching from closing the motor valve to opening the motor valve, the central control panel 7 automatically determines whether the current gas pressure in the gas pipeline is within the normal range, and whether the current gas pipeline has dangerous conditions such as loose interface of gas pipeline, hose breakage, and hose falling. Only when the current gas pressure in the gas pipeline is within the normal range and there is no abnormality in the current gas pipeline, the motor valve is opened to ensure the safety of gas usage of the user.

A method of judging whether there is loose connection, hose breakage or hose falling in the gas pipeline comprises steps of:

in the timed automatic valve closing mode, defining a self-check time period and a detection frequency of the gas safety valve (which are able to be adjusted on the application APP according to the actual situation); within the preset self-check time period, the valve control module automatically closing the motor valve; after the motor valve is closed, through the air exhaust pressure sensor, obtaining the gas pressure value $P_c$ in a segment of the gas pipeline between the motor valve and the kitchen stove in real time, wherein if the segment of the gas pipeline between the motor valve and the kitchen stove is in an absolutely sealed state, there is no downward trend in the obtained gas pressure value $P_c$ and $P_c$ is always under relatively stable pressure; if there is loose connection, hose breakage or hose falling in the segment of the gas pipeline, the obtained gas pressure value $P_c$ shows the downward trend and falls to the atmospheric pressure value $P_a$ of the external environment within a certain period of time; once determining there is loose connection, hose breakage or hose falling in the segment of the gas pipeline, immediately closing the motor valve and sending an alarm to the user terminal through networks. In this embodiment, the detection frequency is set to be once a day, and the self-check time period is from 0 am to 6 am, that is, the gas safety valve automatically performs a safety test on the gas pipeline every day, and timely feeds back safety test results.

The above description is only the preferred embodiments of the present invention and is not intended to limit the present invention. Any modification, equivalent replacement, and improvement made within the spirit and principle of the present invention shall be included in the protection range of the present invention.

What is claimed is:

1. An active kitchen safety monitoring system, which comprises a fire prevention alarm device, a gas safety valve, a multifunctional gateway, a server and a user terminal, wherein: the fire prevention alarm device, the gas safety valve and the multifunctional gateway are in communication connection with each other, the multifunctional gateway is connected with the user terminal through the server;

the fire prevention alarm device is configured to judge whether a kitchen stove has a fire risk based on real-time monitored temperature data of multiple locations on the kitchen stove, and then according to a judgement result, determine whether kitchen stove usage safety alarm information is sent to the multifunctional gateway and whether a motor valve close instruction is sent to the gas safety valve, and then send the real-time monitored temperature data to the multifunctional gateway;

the gas safety valve is configured to control a working state of a motor valve of the gas safety valve according to an internal pressure of a gas pipeline, send internal pressure data of the gas pipeline, working state information of the motor valve and gas usage safety alarm information to the multifunctional gateway, and simultaneously receive an instruction from the multifunctional gateway for daily timing or intelligently opening/closing the motor valve, wherein the gas usage safety alarm information comprises unexpected flameout, overpressure, underpressure, loose connection, hose breakage and hose falling of the gas pipeline;

the multifunctional gateway is configured to receive the temperature data, the internal pressure data of the gas pipeline, the working state information of the motor valve, the kitchen stove usage safety alarm information and the gas usage safety alarm information, send all of the received data and information to the user terminal through the server, and receive and execute an operation instruction from the user terminal;

the server is configured to store the temperature data, the internal pressure data of the gas pipeline, the working state information of the motor valve, receive and send the operation instruction from the user terminal, wherein the operation instruction comprises timing, opening the motor valve and closing the motor valve;

the user terminal is configured to view the temperature data collected by the fire prevention alarm device by a user, the internal pressure data of the gas pipeline, the working state information of the motor valve, the kitchen stove usage safety alarm information and the gas usage safety alarm information, and also configured to control the gas safety valve and the multifunctional gateway.

2. The active kitchen safety monitoring system, as recited in claim 1, wherein the gas safety valve comprises a safety valve housing, a closed valve cavity is provided within the safety valve housing, an air intake port and an air exhaust port are provided on the closed valve cavity, a motor valve for communicating the air intake port and the air exhaust port is located within the closed valve cavity, an air exhaust pressure sensor is located at the air exhaust port; a central control panel, a valve switching button and a first power module are located outside the closed valve cavity and inside the safety valve housing; all of the motor valve, the valve switching button and the first power module are connected with the central control panel through wires and FPCs (Flexible Printed Circuits).

3. The active kitchen safety monitoring system, as recited in claim 2, wherein an air intake pressure sensor and an air exhaust pressure sensor are provided within the closed valve cavity; the air intake pressure sensor, which is located at the air intake port provided on the closed valve cavity, and is electrically connected with the central control panel; the air intake pressure sensor, which is located at the air intake port provided on the closed valve cavity, and is electrically connected with the central control panel.

4. The active kitchen safety monitoring system, as recited in claim 3, wherein the gas safety valve further comprises a prompt module for reminding the user of the current working state information of the motor valve and the usage state of the gas pipeline, wherein the current working state information of the motor valve and the usage state of the gas pipeline comprise the motor valve is opened, the motor valve is closed, insufficient power of the first power module, and loose connection, hose breakage, hose falling, underpressure and overpressure of the gas pipeline; the prompt module is connected with the central control panel through wires or FPCs (Flexible Printed Circuits).

5. The active kitchen safety monitoring system, as recited in claim 3, wherein a leading-out hole is provided on the closed valve cavity; a seal joint is inserted into the leading-out hole; the wires of all of the air exhaust pressure sensor, the air intake pressure sensor and the motor valve are led out from the seal joint and then connected with the central control panel.

6. The active kitchen safety monitoring system, as recited in claim 1, wherein the fire prevention alarm device comprises:

a second private network communication module for connecting with the multifunctional gateway and the gas safety valve;

an alarm module;

an infrared array sensor for monitoring the temperature data at the several locations on the kitchen stove in real time and sending the temperature data monitored to a data processing module;

the data processing module for receiving the temperature data monitored by the infrared array sensor, sending to the multifunctional gateway, respectively finding two maximum temperature data $T_{max1}$ and $T_{max2}$ in the temperature data received both before and after, judging whether the kitchen stove has the fire risk based on a difference between $T_{max1}$ and $T_{max2}$, alarming through the alarm module if the kitchen stove has the fire risk, sending the kitchen stove usage safety alarm information to the multifunctional gateway and sending the motor valve close instruction to the gas safety valve; and a second power module for providing the second private network communication module, the alarm module, the infrared array sensor and the data processing module with power.

7. The active kitchen safety monitoring system, as recited in claim 6, wherein the fire prevention alarm device further comprises a body recognition module for detecting human signals in the kitchen, and an environmental detection module for detecting gas concentration in the kitchen, wherein both the body recognition module and the environmental detection module are connected with the data processing module.

8. The active kitchen safety monitoring system, as recited in claim 7, Wherein the fire prevention alarm device further comprises a timing unit, wherein the timing unit, which is configured to calculate the time that the user leaves the kitchen during cooking, is integrated within the data processing module.

9. The active kitchen safety monitoring system, as recited in claim 1, wherein the multifunctional gateway comprises a third power module, a micro controller module, a third private network communication module for connecting with the gas safety valve and the fire prevention alarm device, a public network communication module for connecting with the server, a display module and a button control module.

10. The active kitchen safety monitoring system, as recited in claim 9, wherein the multifunctional gateway further comprises a voice broadcast module for reminding the user of related information of the gas safety valve and the multifunctional gateway.

11. The active kitchen safety monitoring system, as recited in claim 9, wherein the button control module comprises seven control buttons, which are respectively as follows:

an ignore button, wherein the alarm is stopped by pressing the ignore button under abnormal alarm states;

a valve control button for changing the working state of the current motor valve;

five selection buttons for respectively setting hours, ten minutes, minutes of timing, resetting and starting to control the on/off of the motor valve of the gas safety valve by the user.

12. A control method of an active kitchen safety monitoring system, wherein the control method is performed at an intelligent switch safety valve mode and comprises steps of:

(S1) when a motor valve is closed, obtaining a pressure value Pe1 collected by an ambient pressure sensor and a pressure value Po1 collected by an air exhaust pressure sensor, and obtaining a relative pressure Pob1 at an air exhaust port, wherein Pob1=Po1−Pe1;

(S2) when the motor valve is closed and a user presses a fire button of a kitchen stove to ignite, obtaining a pressure value Pe2 collected by the ambient pressure sensor and a pressure value Po2 collected by the air exhaust pressure sensor, and obtaining a relative pressure Pob2 at the air exhaust port, wherein Pob2=Po2−Pe2 and Pob2=0 at this time;

(S3) when a central control panel detects Pob2 is instantaneously reduced to 0, opening the motor valve after a delay of 1 second, and then closing the gas safety valve after a delay of 1 second, and then obtaining a pressure value Pe3 collected by the ambient pressure sensor and a pressure value Po3 collected by the air exhaust pressure sensor after a delay of 1 second, and finally obtaining a relative pressure Pob3 at the air exhaust port, wherein Pob3=Po3−Pe3; and (S4) respectively judging a relationship between Pob3 and Pob1, and a relationship between Pob3 and Pob2, wherein:

if Pob3 is close to Pob1, it is considered that the user pressing the fire button of the kitchen stove to ignite is a fact, a central control panel controls the motor valve to be automatically opened, so that the user normally uses fire;

if Pob3 is close to Pob2, namely, Pob3 is close to 0 Pa, then (S3) is repeated after a delay of 1 second to obtain a relative pressure Pob3' for re-judgement, when an amount of repetitions exceeds 5 times, and Pob3' is always close to Pob2, it is considered that the gas pipeline is fallen off or damaged, the motor valve is closed and pipeline failure is reported through the first private network communication module;

when Pob3' is close to Pob1 during re-judgement, the central control panel controls the motor valve to be automatically opened.

13. The control method of the active kitchen safety monitoring system, as recited in claim 12, wherein the control method is performed at timed automatic switch safety valve mode and comprises steps of:

(S5) defining a self-check time period and a detection frequency of the gas safety valve, and a valve control module automatically closing the motor valve during the defined self-check time period;

(S6) after closing the motor valve, through the air exhaust pressure sensor, obtaining a gas pressure value $P_b$ within a segment of the gas pipeline between the motor valve and the kitchen stove in real-time, wherein if the segment of the gas pipeline is in an absolutely sealed state, there is no downward trend in the gas pressure value $P_b$, and the segment of the gas pipeline is always under steady pressure; if there is a loose connection in the gas pipeline or a hose is broken or the hose is falling off, there is a downward trend in the gas pressure value $P_b$, and the gas pressure value $P_b$ drop to an atmospheric pressure value $P_a$ of an external environment within a certain time, which means that there is the loose connection in the gas pipeline or the hose is broken or the hose is falling off; and (S7) while determining there is the loose connection in the gas pipeline or the hose is broken or the hose is falling off, immediately closing the motor valve, sending an alarm to the third private network communication module of the multifunctional gateway through the first private network communication module, sending an instruction to the server through the public network communication module of the multifunctional gateway, and notifying the user terminal through networks.

14. The control method of the active kitchen safety monitoring system, as recited in claim 13, further comprising intelligently closing the gas safety valve which comprises steps of:

(S8) when the motor valve is opened and the fire continues on the kitchen stove, obtaining a pressure value Pi4 collected by the air intake pressure sensor and a pressure value Po4 collected by the air exhaust pressure sensor, and obtaining a relative pressure Pio4 between an air intake port and an air exhaust port, wherein Pio4=Pi4−Po4;

(S9) when the motor valve is opened and there is no fire on the kitchen stove, obtaining a pressure value Pi5 collected by the air intake pressure sensor and a pressure value Po5 collected by the air exhaust pressure sensor, and obtaining a relative pressure Pio5 between the air intake port and the air exhaust port, wherein Pio5=Pi5−Po5; and (S10) obtaining a pressure loss Pd=Pio4−Pio5, determining that the user turning off the kitchen stove is a fact when Pd is close to a threshold value N and the central control panel completes valve closing detection after a delay of t, and closing the motor valve.

15. The control method of the active kitchen safety monitoring system, as recited in claim 14, further comprising a motor valve closing detection process which comprises steps of:

(S11) when Pd is close to the threshold valve N and the delay time t has expired, the central control panel controlling the motor valve to slowly turn off, wherein the motor valve is gradually closed to a certain degree and stays for a period of time after being closed to the certain degree every time, Pd' is obtained; and (S12) judging a variation tendency of Pd', wherein:

if Pd' is larger than the threshold value M, it is considered that at this time, there is a small flow of gas circulation, the user is using the minimum fire, this test is over, and the motor valve is fully opened;

if the motor valve is gradually closed till the motor valve is fully closed, Pd' is always lower than the threshold value N, it is considered that at this time, the user turning off the kitchen stove is a fact, so that it is determined that the motor valve is turned off, wherein the threshold value N is 30 Pa, the threshold value M is 50 Pa, the time t is 10 min.

* * * * *